US010474046B2

(12) United States Patent
Srinivasan et al.

(10) Patent No.: US 10,474,046 B2
(45) **Date of Patent: *Nov. 12, 2019**

(54) CRASH COOLING METHOD TO PREPARE TONER

(71) Applicant: LEXMARK INTERNATIONAL, INC., Lexington, KY (US)

(72) Inventors: Kasturi Rangan Srinivasan, Longmont, CO (US); Rahel Bekru Bogale, Firestone, CO (US); Trent Duane Peter, Johnstown, CO (US); Brian David Munson, Mead, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/137,693

(22) Filed: Sep. 21, 2018

(65) Prior Publication Data

US 2019/0025724 A1 Jan. 24, 2019

Related U.S. Application Data

(63) Continuation of application No. 15/629,018, filed on Jun. 21, 2017, now Pat. No. 10,108,100.

(51) Int. Cl.

| | |
|---|---|
| ***G03G 9/08*** | (2006.01) |
| ***G03G 9/087*** | (2006.01) |
| ***G03G 9/093*** | (2006.01) |
| *G03G 15/10* | (2006.01) |

(52) U.S. Cl.

CPC ..... *G03G 9/08797* (2013.01); *G03G 9/0802* (2013.01); *G03G 9/0804* (2013.01); *G03G 9/0806* (2013.01); *G03G 9/08711* (2013.01); *G03G 9/08755* (2013.01); *G03G 9/09328* (2013.01); *G03G 9/09364* (2013.01); *G03G 9/09371* (2013.01); *G03G 9/09378* (2013.01); *G03G 9/09385* (2013.01); *G03G 9/09392* (2013.01); *G03G 9/08704* (2013.01); *G03G 9/08775* (2013.01); *G03G 15/104* (2013.01)

(58) Field of Classification Search

CPC ... G03G 9/0802; G03G 9/0804; G03G 9/0806
USPC ..... 430/137.14
See application file for complete search history.

(56) References Cited

U.S. PATENT DOCUMENTS 10,108,100 B1 * 10/2018 Srinivasan ..... G03G 9/08797

* cited by examiner

*Primary Examiner* — Mark A Chapman

(57) ABSTRACT

The present disclosure relates generally to a method to make a chemically prepared toner that employs a crash cooling process. In particular, the crash cooling process involves the addition of a toner slurry having a temperature between 70° C. and 90° C. to an equivalent amount of cold water having a temperature between 5° C. and 20° C. Polyester and styrene acrylic toners as well as polyester core shell toners having a borax coupling agent between the toner core and toner shell made from this cooling process results in an improvement to the amount of toner waste, thereby achieving a higher toner usage efficiency for an electrophotographic printing system.

4 Claims, 2 Drawing Sheets

CRASH COOLING METHOD TO PREPARE TONER

CROSS REFERENCES TO RELATED APPLICATIONS

This application claims priority as a continuation of U.S. patent application Ser. No. 15/629,018, filed Jun. 21, 2017, having the same title.

BACKGROUND

Field of the Disclosure

The present invention relates generally to a method to produce chemically prepared toners for use in electrophotography and more particularly to a method for preparing a chemically prepared toner using a crash cooling step wherein a quantity of hot toner slurry is added to a similar quantity of chilled cooling water.

Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

One process for preparing a CPT is by emulsion aggregation. Emulsion aggregation is carried out in an aqueous system resulting in good control of both the size and shape of the toner particles. The toner components typically include a polymer binder, one or more colorants and a release agent.

Known crash cooling processes for preparing a CPT by emulsion aggregation involve the addition of cooling water, in particular chilled water, following a toner rounding step and prior to filtration, in what is called a crash cooling step. A known crash cooling method adds an amount of cooling water that is equivalent to the amount of reactor batch of toner, thereby limiting the quantity of toner that can be produced from a single reactor batch. Additionally, toner made using this crash cooling method has crystalline domains on the surface of the toner and an undesirable distribution of raw materials such as wax domains near the toner surface and/or in the toner bulk which negatively affects the performance of the resulting toner in a printing or imaging application. Improvement is needed.

SUMMARY

A crash cooling method for producing toner for electrophotography according an embodiment, includes combining and agglomerating a polymer latex with a pigment dispersion and a wax dispersion to form toner particles, the toner particles being suspended in a aqueous medium, thereby forming a toner slurry. Once the toner particles reach a predetermined size, the temperature is elevated, and once the toner particles reach a predetermined circularity, the hot toner slurry is added to cold water to crash cool the toner particles. The ratio of hot toner slurry to cold water is at least 1:1 by weight. The hot toner slurry has a temperature between 70° C. and 90° C., preferably between 80° C. and 84° C. The cold water has a temperature between 5° C. and 20° C., preferably between 7° C. and 14° C.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
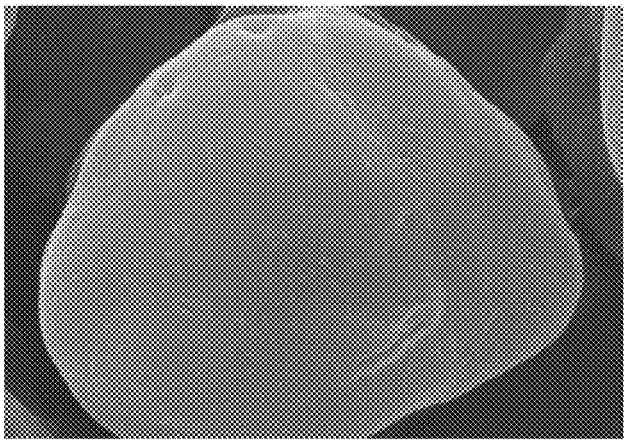
FIG. 1 is a scanning electron microscope image of an oxygen plasma etching of a styrene acrylic toner particle prepared by adding cold water to hot toner slurry.

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure relates to a method of preparing of crash cooling a toner with chilled water. The toner is utilized in an electrophotographic printer such as a printer, copier, multi-function device or an all-in-one device. The toner may be provided in a cartridge that supplies toner to the electrophotographic printer. Example methods of forming toner using emulsion aggregation techniques are found in U.S. Pat. Nos. 6,531,254 and 6,531,256, which are incorporated by reference herein in their entirety. Additionally, U.S. Pat. Nos. 8,669,035 and 9,023,569 disclose example toner formulations and methods of making toner using a borax coupling agent and are assigned to the applicants of the present invention and are incorporated by reference herein in their entirety.

In the present emulsion aggregation process, the toner particles are manufactured by chemical methods as opposed to physical methods such as pulverization. Generally, the toner includes one or more polymer binders, a core shell latex, a release agent or wax, a colorant, an optional borax coupling agent and one or more optional additives such as a charge control agent (CCA).

A detailed synthesis of the toner of the present invention is set forth as follows: An emulsion of a polymer binder is formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired.

The polymer latex or a mixture of polymer latex resin systems, colorant, release agent and the optional CCA are dispersed separately in their own aqueous environments or in one aqueous mixture, as desired, in the presence of a stabilizing agent having similar functionality (and ionic charge) as the stabilizing agent employed in the polymer latex. The polymer latex forming the toner core, the colorant dispersion, the release agent dispersion and the optional CCA dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around (e.g., ±5° C.) the glass transition temperature (Tg) of the polymer latex to induce the growth of clusters of the aggregate particles, to a particle size near the expected toner particle size, i.e. 6-7 microns (μm). Once the aggregate particles reach the desired size of the toner core, the borax coupling agent is added so that it forms on the surface of the toner core. Following addition of the borax coupling agent, the polymer latex forming the toner shell is added. This polymer latex aggregates around the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired circularity. Once a desired circularity is achieved, the system is cooled. The crash cooling process of the present invention involves the addition of the hot toner slurry to an equivalent amount of de-ionized water maintained at about 11° C. The toner particles are then filtered out of the toner slurry, washed with de-ionized water, and filtered again. This process is repeated until the conductivity of the filtrate reaches a desired value.

The toner particles produced may have an average particle size of between about 3 μm and about 20 μm (volume average particle size) including all values and increments therebetween, such as between about 4 μm and about 15 μm or, more particularly, between about 5 μm and about 7 μm. The toner particles produced may have an average degree of circularity between about 0.90 and about 1.00, including all values and increments therebetween, such as about 0.93 to about 0.98. The average degree of circularity and average particle size may be determined by a Sysmex Flow Particle Image Analyzer (e.g., FPIA-3000) available from Malvern Instruments, Ltd., Malvern, Worcestershire, UK. The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

As mentioned above, the toners herein include one or more polymer binders. The terms resin and polymer are used interchangeably herein as there is no technical difference between the two. In one embodiment, the polymer binder(s) include styrene-acrylate polymers. In an alternative embodiment, the polymer binder(s) include polyesters. The polyester binder(s) are amorphous polyester binder and non-crystalline polyester binders. Alternatively, the polyester binder(s) may include a polyester copolymer binder resin. For example, the polyester binder(s) may include a styrene/acrylic-polyester graft copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. Example polyester resins include, but are not limited to, T100, TF-104, NE-1582, NE-701, NE-2141, NE-1569, Binder C, FPESL-2, W-85N, TL-17, TPESL-10, TPESL-11 polyester resins from Kao Corporation, Bunka Sumida-ku, Tokyo, Japan, or mixtures thereof. The polymer binder(s) also includes a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacryla to copolymer and/or polymers made from styrene-butyl acrylate and other acrylic monomers such as hydroxy acrylates or hydroxyl methacrylates); polyvinyl acetate, polyalkenes, poly(vinyl chloride), polyurethanes, polyamides, silicones, epoxy resins, or phenolic resins.

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments therebetween. For example, the colorant may be present in the dispersion at a level of about 10% to about 15% by weight. The dispersion of colorant may contain particles at a size of about 50 nanometers (nm) to about 500 nm including all values and increments therebetween. Further, the colorant dispersion may have a pigment weight percent divided by dispersant weight percent (P/D ratio) of about 1:1 to about 8:1 including all values and increments therebetween, such as about 2:1 to about 5:1. The colorant may be present at less than or equal to about 15% by weight of the final toner formulation including all values and increments therebetween.

The wax used may include any compound that facilitates the release of toner from a component in an electrophotographic printer (e.g., release from a roller surface). The term 'release agent' can also be used to describe a compound that facilitates the release of toner from a component in an electrophotographic printer. For example, the release agent or wax may include polyolefin wax, ester wax, polyester wax, polyethylene wax, Fischer-Tropsch wax, metal salts of fatty acids, fatty acid esters, partially saponified fatty acid esters, higher fatty acid esters, higher alcohols, paraffin wax, carnauba wax, amide waxes, natural wax such as Carnauba wax, and polyhydric alcohol esters or mixtures thereof.

The wax or release agent may therefore include a low molecular weight hydrocarbon based polymer (e.g., Mn≤10,000) having a melting point of less than about 140° C. including all values and increments between about 50° C. and about 140° C. The wax may be present in the dispersion at an amount of about 5% to about 35% by weight including all values and increments there between. For example, the wax may be present in the dispersion at an amount of about 10% to about 18% by weight. The wax dispersion may also contain particles at a size of about 50 nm to about 1 μm including all values and increments there between. In addition, the wax dispersion may be further characterized as having a wax weight percent divided by dispersant weight percent (RA/D ratio) of about 1:1 to about 30:1. For example, the RA/D ratio may be about 3:1 to about 8:1. The wax is provided in the range of about 2% to about 20% by weight of the final toner formulation including all values and increments there between. Exemplary waxes having these above enumerated characteristics include, but are not limited to, SD-A01, SD-B01, MPA-A02, CM-A01 and CM-B01 from Cytech Products, Inc., and Polywax 500 from Baker Petrolite, WE5 from Nippon Oil and Fat and FTX-1 wax from Michelman.

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. Nos. 6,991,884 and 5,714,538, which are assigned to the assignee of the present application and are incorporated by reference herein in their entirety.

The surfactant, as used herein, may be a conventional surfactant known in the art for dispersing non self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above. The charge control agent may be based on a metal salicylate complex such as Zinc salicylate, Boron salicylate, Aluminum salicylate, etc.

The toner formulation may include one or more additional additives, such as acids and/or bases, emulsifiers, extra particular additives, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof.

The following examples are provided to further illustrate the teachings of the present disclosure, not to limit the scope of the present disclosure.

Toner Formulation Examples

Example Styrene-Acrylate Cyan Toner Preparation Using Prior Art Crash Cooling Method (Comparative Example 1)

In a 500 L reactor were placed about 4.35 parts of PB 15:3 pigment dispersion, 7.0 parts of FTX-1 wax dispersion, 3.75 parts of aluminum salicylate dispersion, 16.98 parts of a medium Tg/medium molecular weight styrene acrylate latex dispersion (Tg=57° C., peak molecular weight (Mp) ~308000), 5.66 parts of a high Tg/high molecular weight styrene-acrylate latex dispersion (Tg=58° C., Mp~864000), and about 62.26 parts of a low Tg/low molecular weight styrene-Acrylate latex dispersion (Tg=42° C., Mp~20800), along with about 3.33 parts of a surfactant such as Akypo RLM100. Sufficient water as added to achieve about 13% solids. The use of a high shear mixer can be employed to achieve efficient mixing and flocculation following the addition of an inorganic acid. De-stabilization of the pigment dispersion, wax dispersion, CCA dispersion and latex emulsions were achieved by the addition of an acid such as sulfuric acid (2% concentration), until a pH of about 1.95 is achieved. The de-stabilization can involve a change in stirring speed so as to achieve a desired particle size. The reactor solution temperature was increased to about 52° C.

with constant stirring, followed by a steady ramp to about 58° C. to achieve a particle size of about 6.8 microns (μm) in size (volume). The reaction mixture is then cooled to about 49° C., followed by addition of a 5% sodium hydroxide solution, until a pH of about 7.0 to 7.4 is achieved. The reaction mixture is then heated to about 115° C. to bring about the rounding or coalescing of the particles. On achieving a particle circularity of about 0.965 to about 0.978, the system is cooled. The cooling process involves the addition of an equivalent amount of de-ionized water (amount similar to the reactor toner slurry) maintained at about 11° C., to the hot toner slurry in the reactor. The toner particles are then filtered out of the toner slurry, washed with de-ionized water, and filtered again. This process is repeated until the conductivity of the filtrate is less than or equal to about 5 μS/cm. The toner particles are then dried.

Example Styrene-Acrylate Cyan Toner Preparation Using Inventive Crash Cooling Method (Example 1)

In a 500 L reactor were placed about 4.35 parts of PB 15:3 pigment dispersion, 7.0 parts of FTX-1 wax dispersion, 3.75 parts of aluminum salicylate dispersion, 16.98 parts of a medium Tg/medium molecular weight styrene-acrylate latex dispersion (Tg=57° C., Mp~308000), 5.66 parts of a high Tg/high molecular weight styrene-acrylate latex dispersion (Tg=58° C., Mp~864000), and about 62.26 parts of a low Tg/low molecular weight styrene-Acrylate latex dispersion (Tg=42° C., Mp~20800), along with about 3.33 parts of a surfactant such as Akypo RLM100. In a manner similar to Comparative Example 1, the emulsion agglomeration was carried out, until the required particle size of about 6.5 μm-6.8 μm in size (by volume) and particle circularity of about 0.965 to about 0.978 was achieved. The cooling process involves the addition of the toner slurry that was cooled to about 82° C. to an external container that has a similar amount of de-ionized water, wherein the deionized water is maintained at about 11° C. Toner particles are then filtered out of the toner slurry, washed with de-ionized water, and filtered again. This process is repeated until the conductivity of the filtrate is less than or equal to about 5 μS/cm. The toner particles are then dried.

Example Styrene-Acrylate Magenta Toner Preparation Using Prior Art Crash Cooling Method (Comparative Example 2)

In a 500 L reactor were placed about 5.1 parts of PR122 pigment dispersion, 1.7 parts PR185, 7.0 parts of FTX-1 wax dispersion, 3.75 parts of aluminum salicylate dispersion, 16.49 parts of a medium Tg/medium molecular weight styrene-acrylate latex dispersion (Tg=57° C., Mp~308000), 5.50 parts of a high Tg/high molecular weight styrene-acrylate latex dispersion (Tg=58° C., Mp~864000), and about 60.46 parts of a low Tg/low molecular weight styrene-Acrylate latex dispersion (Tg=42° C., Mp~20800), along with about 3.33 parts of a surfactant such as Akypo RLM100. In a manner similar to Comparative Example 1, the emulsion agglomeration was carried out, until the required particle particle size of about 6.5 μm-6.8 μm in size (by volume) and particle circularity of about 0.965 to about 0.978 was achieved. The cooling process involves the addition of an equivalent amount of de-ionized water (amount similar to the reactor toner slurry) maintained at about 11° C., to the hot toner slurry in the reactor. The toner particles are then filtered out of the toner slurry, washed with de-ionized water, and filtered again. This process is repeated until the conductivity of the filtrate is less than or equal to about 5 μS/cm. The toner particles are then dried.

Example Styrene-Acrylate Magenta Toner Preparation Using Inventive Crash Cooling Method (Example 2)

In a 500 L reactor were placed about 5.1 parts of PR122 pigment dispersion, 1.7 parts PR185, 7.0 parts of FTX-1 wax dispersion, 3.75 parts of aluminum salicylate dispersion, 16.49 parts of a medium Tg/medium molecular weight styrene-acrylate latex dispersion (Tg=57° C., Mp~308000), 5.50 parts of a high Tg/high molecular weight styrene-acrylate latex dispersion (Tg=58° C., Mp~864000), and about 60.46 parts of a low Tg/low molecular weight styrene-Acrylate latex dispersion (Tg=42° C., Mp~20800), along with about 3.33 parts of a surfactant such as Akypo RLM100. In a manner similar to Comparative Example 1, the emulsion agglomeration was carried out, until the required particle particle size of about 6.5 μm-6.8 μm in size (by volume) and particle circularity of about 0.965 to about 0.978 was achieved. The cooling process involves the addition of the toner slurry that was cooled to about 82° C. to an external container that has a similar amount of de-ionized water, wherein the deionized water is maintained at about 11° C. The toner particles are then filtered out of the toner slurry, washed with de-ionized water, and filtered again. This process is repeated until the conductivity of the filtrate is less than or equal to about 5 μS/cm. The toner particles are then dried.

Example Styrene-Acrylate Yellow Toner Preparation Using Prior Art Crash Cooling Method (Comparative Example 3)

In a 500 L reactor were placed about 6.0 parts of PY74 pigment dispersion, 7.0 parts of FTX-1 wax dispersion, 3.75 parts of aluminum salicylate dispersion, 16.65 parts of a medium Tg/medium molecular weight styrene-acrylate latex dispersion (Tg=57° C., Mp~308000), 5.55 parts of a high Tg/high molecular weight styrene-acrylate latex dispersion (Tg=58° C., Mp~864000), and about 61.05 parts of a low Tg/low molecular weight styrene-Acrylate latex dispersion (Tg=42° C., Mp~20800), along with about 3.33 parts of a surfactant such as Akypo RLM100. In a manner similar to Comparative Example 1, the emulsion agglomeration was carried out, until the required particle particle size of about 6.5 μm-6.8 μm in size (by volume) and particle circularity of about 0.965 to about 0.978 was achieved. The cooling process involves the addition of an equivalent amount of de-ionized water (amount similar to the reactor toner slurry) maintained at about 11° C. to the reactor toner slurry, that is held at about 82° C. The toner particles are then filtered out of the toner slurry, washed with de-ionized water, and filtered again. This process is repeated until the conductivity of the filtrate is less than or equal to about 5 μS/cm. The toner particles are then dried.

Example Styrene-Acrylate Yellow Toner Preparation Using Inventive Crash Cooling Method (Example 3)

In a 500 L reactor were placed about 6.0 parts of PY74 pigment dispersion, 7.0 parts of FTX-1 wax dispersion, 3.75 parts of aluminum salicylate dispersion, 16.65 parts of a medium Tg/medium molecular weight styrene-acrylate latex dispersion (Tg=57° C., Mp~308000), 5.55 parts of a high Tg/high molecular weight styrene-acrylate latex dispersion (Tg=58° C., Mp~864000), and about 61.05 parts of a low Tg/low molecular weight styrene-Acrylate latex dispersion (Tg=42° C., Mp~20800), along with about 3.33 parts of a surfactant such as Akypo RLM100. In a manner similar to Comparative Example 1, the emulsion agglomeration was carried out, until the required particle particle size of about 6.5 μm-6.8 μm in size (by volume) and particle circularity of about 0.965 to about 0.978 was achieved. The cooling process involves the addition of the toner slurry that was cooled to about 82° C. to an external container that has a similar amount of de-ionized water, wherein the deionized water is maintained at about 11° C. The toner particles are then filtered out of the toner slurry, washed with de-ionized water, and filtered again. This process is repeated until the conductivity of the filtrate is less than or equal to about 5 μS/cm. The toner particles are then dried.

Example Black Toner Preparation Using Prior Art Crash Cooling Method (Comparative Example 4)

In a 500 L reactor were placed about 8.00 parts of Nipex 35 carbon black pigment dispersion, 7.0 parts of FTX-1 wax dispersion, 3.75 parts of aluminum salicylate dispersion, 16.25 parts of a medium Tg/medium molecular weight styrene-acrylate latex dispersion (Tg=57° C., Mp~308000), 5.42 parts of a high Tg/high molecular weight styrene-acrylate latex dispersion (Tg=58° C., Mp~864000), and about 59.58 parts of a low Tg/low molecular weight styrene-Acrylate latex dispersion (Tg=42° C., Mp~20800), along with about 3.33 parts of a surfactant such as Akypo RLM100. In a manner similar to Comparative Example 1, the emulsion agglomeration was carried out, until the required particle particle size of about 6.5 μm-6.8 μm in size (by volume) and particle circularity of about 0.965 to about 0.978 was achieved. The cooling process involves the addition of an equivalent amount of de-ionized water (amount similar to the reactor toner slurry) maintained at about 11° C. to the reactor toner slurry, that is held at about 82° C. The toner particles are then filtered out of the toner slurry, washed with de-ionized water, and filtered again. This process is repeated until the conductivity of the filtrate is less than or equal to about 5 μS/cm. The toner particles are then dried.

Example Black Toner Preparation Using Inventive Crash Cooling Method (Example 4)

In a 500 L reactor were placed about 8.00 parts of Nipex 35 carbon black pigment dispersion, 7.0 parts of FTX-1 wax dispersion, 3.75 parts of aluminum salicylate dispersion, 16.25 parts of a medium Tg/medium molecular weight styrene-acrylate latex dispersion (Tg=57° C., Mp~308000), 5.42 parts of a high Tg/high molecular weight styrene-acrylate latex dispersion (Tg=58° C., Mp~864000), and about 59.58 parts of a low Tg/low molecular weight styrene-Acrylate latex dispersion (Tg=42° C., Mp~20800), along with about 3.33 parts of a surfactant such as Akypo RLM100. In a manner similar to Comparative Example 1, the emulsion agglomeration was carried out, until the required particle particle size of about 6.5 μm-6.8 μm in size (by volume) and particle circularity of about 0.965 to about 0.978 was achieved. The cooling process involves the addition of the toner slurry that was cooled to about 82° C. to an external container that has a similar amount of de-ionized water, wherein the deionized water is maintained at about 11° C. The toner particles are then filtered out of the toner slurry, washed with de-ionized water, and filtered again. This process is repeated until the conductivity of the filtrate is less than or equal to about 5 μS/cm. The toner particles are then dried.

Description of Test Procedures and Test Results

To gain a better understanding of wax domain size and distribution in the aforementioned described example styrene-acrylic toners, their respective fractured toner particles were studied using a scanning electron microscope (SEM). In a typical fracture test, a styrene-acrylic EA toner with no surface additives is compressed under pressure to form a puck. These pucks are then broken in to smaller pieces and encapsulated in epoxy resin. Following the drying of the epoxy layer, these pucks are placed in a cryogenic system using liquid nitrogen to cool. The cryogenically cooled samples are then cracked using a sharp edge such as a razor blade. Exposed toner in the epoxy layer is then etched using oxygen plasma to highlight the surface interfaces. The wax particles are typically less compatible with the resin and pigment and hence form domains, which under cryogenic condition can be broken and removed, and with the available SEM technique, the shape and possibly the size of the fractured wax domains can be measured. A JEOL JSM 6610V Scanning Electron Microscope was used in evaluation of the toner surfaces.

Surface Wax Domains

Figure 2:
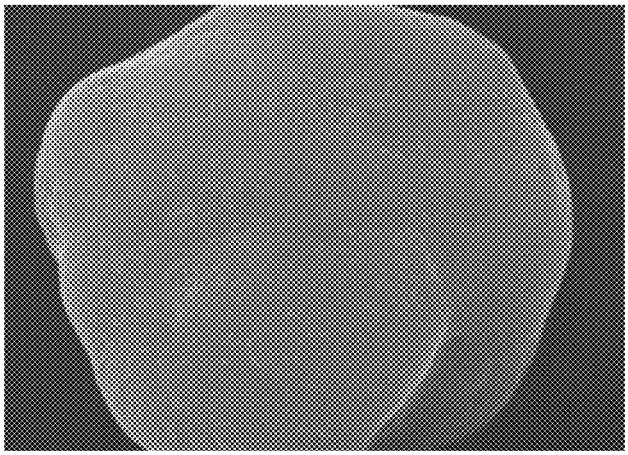
FIG. 2 is a scanning electron microscope image of an oxygen plasma etching of a styrene acrylic toner particle prepared by adding hot toner slurry to cold water.

FIGS. 1 and 2 are SEM images of toner particles formed following an etching process with oxygen plasma. FIG. 1 is a SEM image of the Comparative Example 2 toner cooled using the prior art crash cooling process and shows this particular toner having some surface wax, as indicated by the wax domain size, appears as a scar on the toner surface. In contrast, FIG. 2 is a SEM image of the Example 2 toner cooled using inventive crash cooling process and shows this particular toner does not show any large wax domains. Although there is surface wax for Example 2, the size of the domain is significantly smaller than Comparative Example 2.

Wax Domains in Bulk

Figure 3:
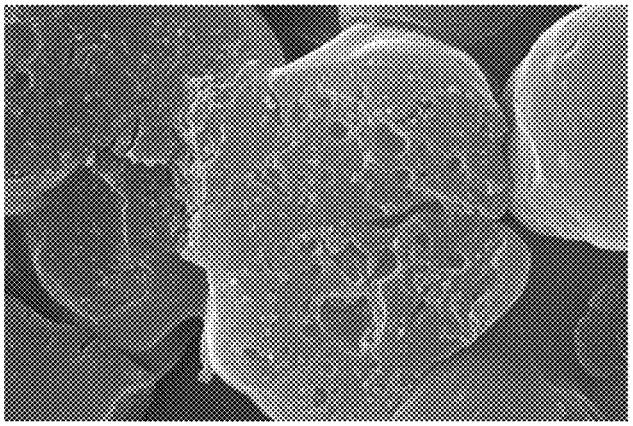
FIG. 3 is a scanning electron microscope image of a cross section of fractured cryogenically cooled styrene acrylic toner particles exposing wax domains within the toner bulk.
Figure 4:
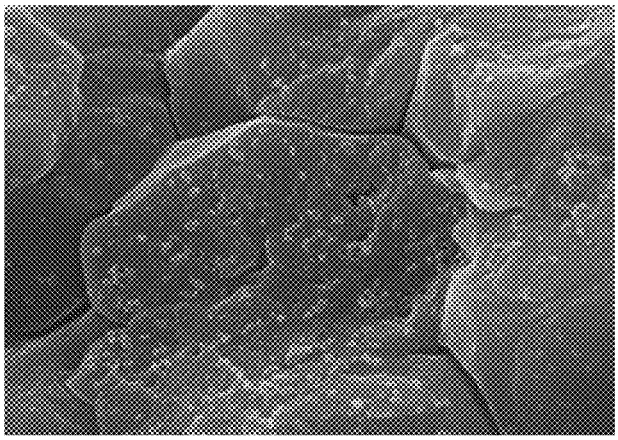
FIG. 4 is a scanning electron microscope image of a cross section of fractured cryogenically cooled styrene acrylic toner particles exposing wax domains within the toner bulk.

FIGS. 3 and 4 are images of a toner bulk for the Comparative Example Toner 4 and Example Toner 4, respectively. These images are achieved by fracturing a cryogenically cooled toner, as described hereinabove. The image of the toner bulk for Comparative Example Toner 4 in FIG. 3 shows domains that range from a cylindrical shape to a spherical shape. Additionally, these domains vary in their domain size. However, FIG. 4 corresponding to Example Toner 4 cooled by an inventive crash cooling method, shows only spherical domains and size for these domains are relatively uniform. Therefore, it may be appreciated that although the toner preparation process is similar for Comparative Examples 1 through 4 and Examples 1 through 4 respectively, the wax domain size may be modified in a desirable manner by employing the inventive crash cooling method of adding the toner slurry to an external container having an equivalent amount of chilled water.

Toners as prepared shown above in Comparative Examples 1 through 4 and Examples 1 through 4 were evaluated in a Lexmark C792 printer using a continuous run mode and a 15% coverage on page, as shown in Table 1. Toners as prepared shown above in Comparative Examples 1 through 4 and Examples 1 through 4 were surface treated with the following surface additives: 0.5% by weight small silica, 0.7% by weight of medium silica, 1.7% of large silica, 0.05% alumina and about 0.25% acicular titania. Cooling method A employs a prior art crash cooling step wherein an equivalent amount of deionized chilled water is added to the hot toner slurry. Cooling method B is the inventive crash cooling method wherein an equivalent amount of hot toner slurry is added to the chilled deionized water in an external container. The temperature of the hot toner slurry can range from about 80° C. to about 84° C. The temperature of the chilled deionized water can range from about 7° C. to about 14° C.

TABLE 1

Printer results in a Lexmark C792, using a 15% coverage, run continuously, run to 25000 pages

| Toner ID | Cooling Method | Toner Charge (μC/g) | Avg. Toner Mass on Developer Roller (mg/cm$^2$) | Avg. Toner Usage (mg/pg) | Toner-to-Cleaner (mg/pg) | Avg. L* or b* |
|---|---|---|---|---|---|---|
| Comp. Ex 1 | A | −27.6 | 0.32 | 46.3 | 3.85 | 53.4 |
| Example 1 | B | −31.4 | 0.28 | 45.3 | 3.52 | 53.6 |
| Comp. Ex 2 | A | −24.3 | 0.31 | 45.3 | 4.57 | 47.31 |
| Example 2 | B | −29.4 | 0.26 | 43.3 | 3.86 | 47.34 |
| Comp. Ex 3 | A | −29.6 | 0.30 | 44.80 | 2.26 | 100.3 |
| Example 3 | B | −36.1 | 0.26 | 45.4 | 2.22 | 99.5 |
| Comp. Ex 4 | A | −36.5 | 0.30 | 41.5 | 3.60 | 13.51 |
| Example 4 | B | −36.7 | 0.26 | 42.6 | 2.87 | 13.07 |

Toners as prepared shown above in Comparative Examples 1 through 4 and Examples 1 through 4 were surface treated with the following surface additives: 0.5% by weight small silica, 0.7% by weight of medium silica, 1.7% of large silica, 0.05% alumina and about 0.25% acicular titania. Toners were evaluated in a Lexmark C792 printer using a spot color run mode (1% print coverage), to mimic a situation wherein the toner continuously churned in the cartridge and could be more prone to filming cartridge components. Cooling method A employs a prior art crash cooling step wherein an equivalent amount of deionized chilled water is added to the hot toner slurry. Cooling method B is the inventive crash cooling method wherein an equivalent amount of hot toner slurry is added to the chilled deionized water in an external container. The temperature of the hot toner slurry can range from about 80° C. to about 84° C. The temperature of the chilled deionized water can range from about 7° C. to about 14° C.

TABLE 2

Printer results in a Lexmark C792, using a spot color run mode (1% coverage), run to 25000 pages.

| Toner ID (Surface Treated with Additives) | Cooling Method | Avg. Toner Charge (μC/g) | Avg. Toner Mass on Developer Roller (mg/cm$^2$) | Toner Usage (mg/pg) | Toner-to-Cleaner (mg/pg) | Avg. L* or b* | Toner leaks |
|---|---|---|---|---|---|---|---|
| Comp. Ex 1 | A | −26.59 | 0.31 | 6.40 | 1.83 | 54.6 | 10000 pgs |
| Example 1 | B | −32.50 | 0.28 | 7.13 | 1.83 | 55.3 | None |
| Comp. Ex 2 | A | −27.8 | 0.33 | 7.03 | 2.48 | 48.3 | 10000 pages |
| Example 2 | B | −32.8 | 0.27 | 5.20 | 1.49 | 47.8 | None |
| Comp. Ex 3 | A | −29.5 | 0.32 | 5.82 | 1.33 | 96.6 | None |
| Example 3 | B | −33.7 | 0.29 | 5.94 | 1.55 | 99.1 | None |

Table 1 represents the toner performance in a Lexmark 0792 printer, run at about 50 ppm, in a continuous run mode, and 15% print coverage. Toners made using inventive cooling method B (i.e., adding hot toner slurry to an equivalent amount of cold water) result in an increase in toner charge. Moreover, Example 1-4 toners produced using cooling method B show a lower toner mass on the developer roller. While a lower toner mass on developer roller usually results in a lighter print on page, the avg. L* or b* for Example 1 through 4 toners are similar to Comparative Example 1 through 4 toners (produced using the prior art cooling method A). Hence, the higher average toner charge did not result in a lighter print on page. Toner usage as shown in Table 1 corresponds to the total amount of toner used in printing about 25000 pages, shown as milligrams per page. Toner-to-cleaner or waste toner is amount of toner collected in a waste sump/box during the printing process and shown as milligrams per page. It is preferred that Toner-To-Cleaner or waste toner amount is low, to achieve a higher toner usage efficiency for the system. By using the inventive cooling method B, it may be appreciated that addition of the hot toner to cold water externally results in a lower amount of toner waste, in some cases as much as a 10-15% improvement. Also, toners made using the inventive cooling method B did not result in any observable filming of cartridge components.

Table 2 represents the toner performance in a Lexmark C792 printer, run at about 50 ppm, in a spot color run mode, and 1% print coverage to about 25000 pages. As seen in Table 2, Example toners 1 through 3 have a tendency towards a higher average toner charge, lower toner mass on developer roller and were either similar or better than Comparative Example toners 1 through 3 in the reported toner to cleaner. The print density on the page was similar for both cooling methods, indicating that the higher toner charge and lower toner mass on developer roller did not adversely impact the print density on the page. Whereas, Comparative Example toners 1 and 2 had a tendency towards toner leaks from the cartridge which would result in contamination of the cartridge and/or printer, Example toners 1 and 2 made using the inventive crash cooling method B did not show any toner leak through the test.

To further study the impact of the inventive crash cooling method, polyester toners were prepared as outlined in the preparation of the styrene acrylic toner in Comparative Example 1, except no charge control additive is used.

Example Polyester Toner Preparation Using Prior Art Crash Cooling Method (Comparative Example Polyester Toner)

In a 500 L reactor was placed about 5.26 parts of Pigment Red (PR) 122 dispersion, 3.26 parts of Pigment Red PR 185 dispersion, 9.83 parts of a paraffin wax dispersion, 36.2 parts of a medium Tg (Tg=56° C.) polyester resin emulsion, 14.6 parts of a low Tg (Tg=53° C.) polyester resin emulsion and sufficient water to achieve about 13% solids. De-stabilization of the pigment dispersion, wax dispersion, and latex emulsions were achieved by the addition of an acid such as sulfuric acid, until a pH of about 1.5 to 2.3 is achieved. The destabilization can involve a change in stirring speed to achieve a desired particle. The temperature was then increased to about 41° C. and held at this temperature for about 45 minutes to about 90 minutes, to achieve a particle size of about 5.0-5.2 μm (volume). Upon reaching the desired particle size, about 2.77 parts of borax dispersion is added followed by stirring for about 5 to 15 minutes. About 28 parts of a high Tg (Tg=60° C.) polyester resin emulsion is then added, along with de-ionized water. The reaction mixture is then heated to about 45° C. and stirred until a particle size of about 6.0-6.3 μm is achieved. An aqueous base, such as aqueous sodium hydroxide (5% solution), is then added increase the pH to about 6.75-6.9. The temperature is then increased to about 83° C. and the toner shape is monitored by measuring circularity in a FPIA3000 Sysmex instrument. The particle size is also monitored. On achieving a circularity of about 0.965-0.975, the toner slurry is cooled. The cooling process involves the addition of an equivalent weight of de-ionized water (maintained at about 11° C.) to the hot toner slurry. The toner particles are then filtered out of the toner slurry, washed with de-ionized water, and filtered again. This process is repeated until the conductivity of the filtrate is less than or equal to about 5 μS/cm. The toner particles are then dried.

Example Polyester Toner Preparation Using Inventive Crash Cooling Method (Example Poylester Toner)

In a 500 L reactor was placed about 5.26 parts of PR 122 dispersion, 3.26 parts of Pigment Red 185 dispersion, 9.83 parts of a paraffin wax dispersion, 36.2 parts of a medium Tg (Tg=52° C.) polyester resin emulsion, 14.6 parts of a low Tg polyester resin emulsion and sufficient water to achieve about 13% solids. De-stabilization of the pigment dispersion, wax dispersion, and latex emulsions were achieved by the addition of an acid such as sulfuric acid, until a pH of about 1.5 to 2.3 is achieved. The destabilization can involve a change in stirring speed to achieve a desired particle size. The temperature was then increased to about 41° C. and held at this temperature for about 45 minutes to about 90 minutes, to achieve a particle size of about 5.0-5.2 μm (volume). Upon reaching the desired particle size, about 2.77 parts of borax dispersion is added followed by stirring for about 5 to 15 minutes. About 28 parts of a high Tg (Tg=60° C.) polyester resin emulsion is then added, along with de-ionized water. The reaction mixture is then heated to about 45° C. and stirred until a particle size of about 6.0-6.3 μm is achieved. An aqueous base, such as aqueous sodium hydroxide (5% solution), is then added increase the pH to about 6.75-6.9. The temperature is then increased to about 83° C. and the toner shape is monitored by measuring circularity in a FPIA3000 Sysmex instrument. The particle size is also monitored. On achieving a circularity of about 0.965-0.975, the toner slurry is cooled. The cooling process involves the addition of the hot toner slurry to an equivalent weight of de-ionized water, previously chilled to about 11° C. The toner particles are then filtered out of the toner slurry, washed with de-ionized water, and filtered again. This process is repeated until the conductivity of the filtrate is less than or equal to about 5 μS/cm. The toner particles are then dried.

Figure 5:
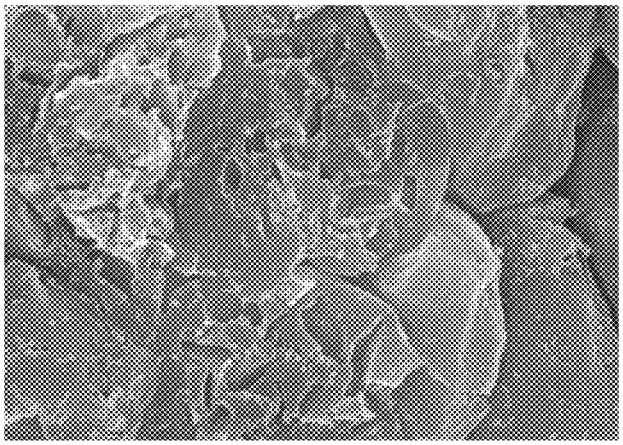
FIG. 5 is a scanning electron microscope image of a cross section of fractured cryogenically cooled polyester toner particles exposing wax domains within the toner bulk that included adding cold water to hot toner slurry.
Figure 6:
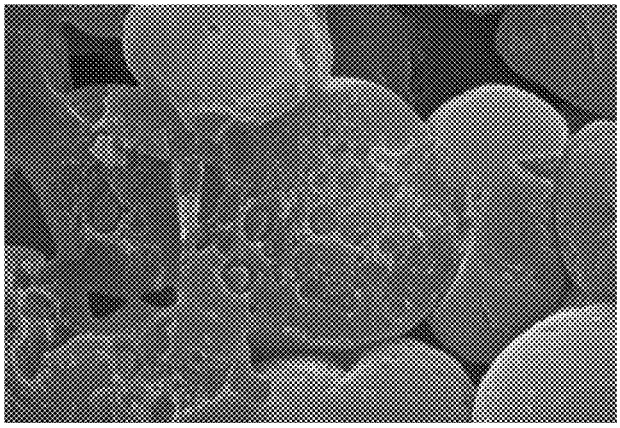
FIG. 6 is a scanning electron microscope image of a cross section of fractured cryogenically cooled polyester toner particles exposing wax domains within the toner bulk that included adding hot toner slurry to cold water.

Comparative Example Polyester Toner and Example Polyester Toner were evaluated for wax domains in the bulk by using samples that were fractured using a cryoscopy technique as outlined earlier and then imaged using a SEM. As shown in FIG. 5, Comparative Example Polyester Toner, made using the prior art cooling process, shows wax domains in the bulk that vary from a cylindrical rod to a spherical structure. In comparison as shown in FIG. 6, Example Polyester Toner made using the inventive cooling process, only exhibit spherical domains. It may be appreciated that the selective control of the wax domain shape, and in turn the performance of toner in a printer can be positively manipulated by using the inventive cooling method of the present invention, wherein the hot toner slurry, having a temperature of about 80° C. to about 84° C., is added to an external reactor having an equivalent amount of chilled water having a temperature of about 7° C. to about 11° C.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A method for producing a core shell toner, comprising:

combining and agglomerating a polymer emulsion with a colorant dispersion and a release agent dispersion to form toner cores;

combining and agglomerating a second polymer emulsion with the toner cores to form toner shells around the toner cores;

fusing the aggregated toner cores and toner shells to form toner particles;

forming a hot toner slurry by suspending the toner particles in an aqueous medium wherein the hot toner slurry has a temperature between 70° C. and 90° C.;

adding the hot toner slurry to cold water in an external container wherein the cold water has a temperature between 5° C. and 20° C. and the quantity of the hot toner slurry is equivalent to the quantity of the cold water;

filtering the toner particles out of the hot toner slurry;

washing the filtered toner particles with deionized water; and repeating the filtering and washing steps until the conductivity of the filtered toner particles less than or equal to 5 μS/cm.

2. The method of claim 1, wherein the hot toner slurry has a temperature between 80° C. and 84° C.

3. The method of claim 1, wherein the cold water has a temperature between 7° C. and 14° C.

4. A toner prepared by the process of claim 1.

* * * * *